US006107745A

United States Patent [19]

Mougin et al.

[11] Patent Number: 6,107,745

[45] Date of Patent: Aug. 22, 2000

[54] ION PUMPING OF A FLAT MICROTIP SCREEN

[75] Inventors: Stephane Mougin, Castelnau le Lez; Lionel Riviere-Cazaux, Montpellier, both of France

[73] Assignee: Pixtech S.A., France

[21] Appl. No.: 09/104,683

[22] Filed: Jun. 25, 1998

[30] Foreign Application Priority Data

Jun. 27, 1997 [FR] France ..... 97 08363

[51] Int. Cl.[7] ..... G09G 3/10

[52] U.S. Cl. ..... 315/169.1; 315/169.3

[58] Field of Search ..... 315/169.3, 169.1, 315/169.2; 313/495, 496

[56] References Cited

U.S. PATENT DOCUMENTS 5,578,900 11/1996 Peng et al. ..... 315/495

5,764,004 6/1998 Rabinowitz ..... 315/169.1

5,889,372 3/1999 Beeteson et al. ..... 315/169.1

5,903,108 5/1999 Mougin et al. ..... 315/169.1

*Primary Examiner*—David Vu

*Assistant Examiner*—Ephrem Alemu

*Attorney, Agent, or Firm*—Arthur L. Plevy; Buchanan Ingersoll P.C.

[57] ABSTRACT

A flat microtip display screen including a cathode provided with active areas of electron emission microtips; a cathodoluminescent anode provided, at least in front of the active microtip areas, with active areas of phosphor elements; a main grid of extraction of electrons emitted by the active microtips towards the phosphor elements; and on the cathode side, at least one sacrificial area of microtips adapted to being addressed, outside screen operation periods and independently from the active areas.

12 Claims, 1 Drawing Sheet

ION PUMPING OF A FLAT MICROTIP SCREEN

BACKGROUND OF THE INVENTION

1. Field of the Invention

The present invention relates to flat microtip display screens. The present invention more specifically relates to the manufacturing of such screens.

2. Discussion of the Related Art

A microtip screen is generally formed of a cathode provided with electron emission microtips placed facing an anode provided with phosphor elements likely to be energized by electron bombarding. The cathode is associated with a grid provided with holes corresponding to the locations of the microtips The microtips are generally arranged on cathode conductors organized in columns and addressable individually. The grid is organized in rows perpendicular to the cathode columns, also addressable individually.

In a color screen, the anode is generally provided with alternate strips of phosphor elements each corresponding to a color (Red, Green, Blue). The strips are parallel to the cathode columns and are separated from one another by an insulator. The phosphor elements are deposited on electrodes formed of corresponding strips of a transparent conductive layer, for example, in indium and tin oxide (ITO).

The intersection of a cathode column and of a grid line defines a screen pixel. For a color screen, the sets of red, green, blue strips are alternately biased with respect to the cathode, so that the electrons extracted from the microtips of a pixel of the cathode/grid are alternately directed to each of the colors. In some color screens where the cathode columns (or the grid lines) are divided in three to correspond to each color, the intersection of a grid row with a cathode column then defines a sub-pixel of a color.

Generally, the grid rows are sequentially biased to a potential on the order of 80 volts, while the strips of phosphor elements to be energized are biased under a voltage on the order of 400 volts via the ITO strip on which the phosphor elements are deposited. The ITO strips, bearing the other strips of phosphor elements, are at a low or zero potential. The cathode columns are brought to respective potentials included between a maximum emission potential and a no emission potential (for example, respectively 0 and 30 volts). The brightness of a color component of each of the pixels in a line is thus determined.

In a monochrome screen, the anode is generally formed of a plane of simultaneously biased phosphor elements of same color, or of two sets of alternate strips of phosphor elements of same color addressed alternately.

The choice of the values of the biasing potentials is linked to the characteristics of the phosphor elements and of the microtips. Usually, below a potential difference of 50 volts between the cathode and the gate, there is no electron emission, and the maximum emission corresponds to a potential difference of 80 volts.

The manufacturing of microtip screens calls up techniques currently used in the manufacturing of integrated circuits. The cathode is generally formed of thin layer depositions on a substrate, for example, made of glass, forming the bottom of the screen. The anode is generally formed on a glass substrate forming the screen surface.

The anode and the cathode-grid are made independently from each other on both substrates, then are assembled by means of a peripheral seal while creating, between the grid and the anode, an empty space to enable the flowing of the electrons emitted by the cathode to the anode.

During assembly, the screen is submitted to various thermal degassing processings. These processings are generally performed under pumping by means of a tube communicating with the empty space and meant to be closed at the end of the manufacturing process.

A getter is generally introduced in the screen, for example, in the tube, before closing. This getter has the function of trapping elements desorbed, in particular by the anode, during screen operation. However, this getter is inactive for neutral species, especially rare gases, which remain in the empty space after closing of the screen.

A trapping of the species remaining in the space between electrodes must thus be caused to improve the vacuum. This ultimate step is performed once the pumping tube is closed. It consists of causing an electron emission by the microtips to ionize neutral species remaining in the space between electrodes. The bombarding of the neutral species causes an extraction of an electron from their valence layer and these species are then positively charged. They are then attracted by the microtips at the most negative potential. This step is generally called an ion pumping.

The present invention more specifically relates to the improvement of the vacuum of the space between electrodes by ion pumping.

A disadvantage of conventional screens is that the ion pumping damages the cathode microtips. Indeed, the collection of the ionized species by the microtips causes a mechanical and/or chemical erosion (especially by rare gases) of the microtips. Although the screen vacuum is improved, a decrease in the microtip emissivity is observed.

Another disadvantage of conventional screens is that, during screen operation, some outgassed species do not succeed in being trapped by the getter. This results in a decrease of the quality of the vacuum which is prejudicial to the screen reliability.

SUMMARY OF THE INVENTION

The present invention aims at providing a novel method of ion pumping of a microtip screen which overcomes the disadvantages of known methods. The present invention aims in particular at improving the microtip emissivity.

The present invention also aims at providing a novel flat display screen structure which is adapted to the implementation of this method.

The present invention also aims at enabling, in a simple way, the implementation of an ion pumping by the screen control system and, in particular, at not requiring the provision of other potentials as those which are conventionally used in a conventional screen for its operation.

The present invention further aims at providing a screen which enables an improvement of the vacuum not only in the screen manufacturing but also after the screen has started to be used.

To achieve these objects, the present invention provides a flat microtip display screen including a cathode provided with active areas of electron emission microtips; a cathodoluminescent anode provided, at least in front of the active microtip areas, with active areas of phosphor elements; a main grid of extraction of electrons emitted by the active microtips towards the phosphor elements; and on the cathode side, at least one sacrificial area of microtips adapted to being addressed, outside screen operation periods and independently from the active areas.

According to an embodiment of the present invention, the sacrificial area of microtips is associated with a secondary grid.

According to an embodiment of the present invention, the screen includes, on the anode side, at least one conductive track above the microtip sacrificial area, the conductive track being, during an ion pumping phase, biased to a potential higher than a potential of biasing of the secondary grid, preferably, to a potential corresponding to a nominal potential of addressing of the active areas of phosphor elements of the anode.

According to an embodiment of the present invention, the secondary grid is biased, during an ion pumping phase, to a potential corresponding to a nominal addressing potential of the main grid during screen operation periods.

According to an embodiment of the present invention, the main and secondary grids are one and the same grid extending above the active and sacrificial microtip areas.

According to an embodiment of the present invention, the sacrificial microtips are addressed, during an ion pumping phase, at a potential included in a range of nominal potentials of addressing of the active areas of microtips during screen operation.

According to an embodiment of the present invention, the surface of the sacrificial area of microtips is between 0.1% and 10% of the surface of the active areas of microtips.

According to an embodiment of the present invention, in which the active microtip areas are organized in parallel columns and addressable independently from one another, the screen includes sacrificial areas of microtips parallel to the columns, each sacrificial area being interposed between two neighboring columns.

According to an embodiment of the present invention, the screen includes two sacrificial microtip areas on either side of the active areas.

The present invention also provides a method of improvement of the vacuum in a flat microtip screen, which consists, during an ion pumping phase, of applying a positive voltage between a grid associated with the sacrificial microtips and the sacrificial microtip area.

According to an embodiment of the present invention, an ion pumping phase is performed before using the screen.

According to an embodiment of the present invention, an ion pumping phase is performed after each period of screen operation.

The foregoing objects, features and advantages of the present invention, will be discussed in detail in the following non-limiting description of specific embodiments made in connection with the accompanying drawings.

DETAILED DESCRIPTION

Figure 1:
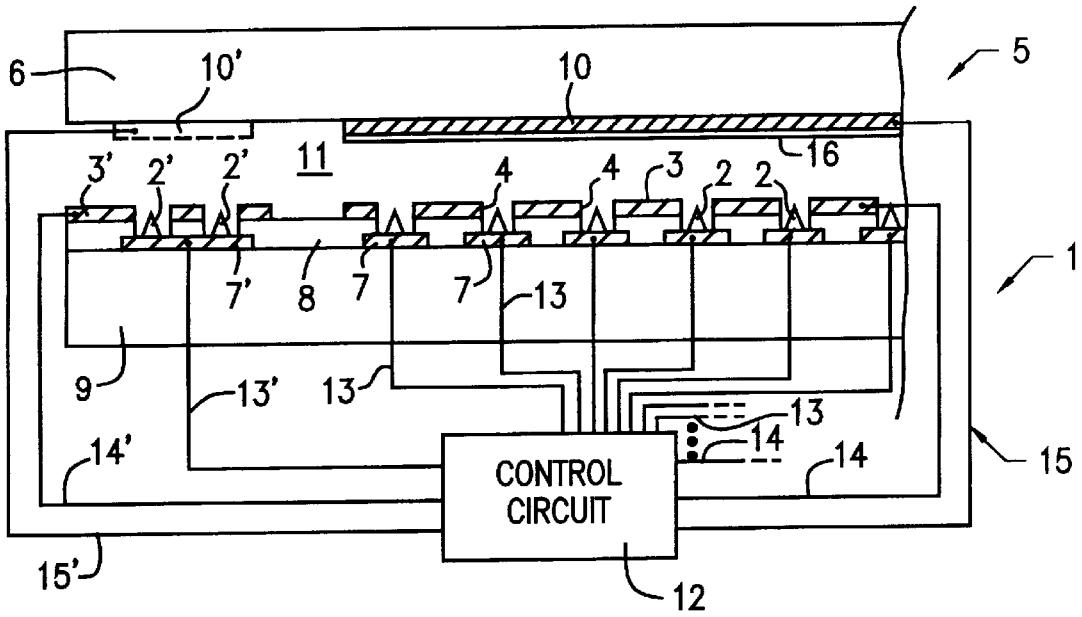
FIG. 1 shows, partially and in cross-sectional view, a flat microtip display screen according to an embodiment of the present invention.

For clarity, only those elements of the screen and those steps of the method which are necessary to the understanding of the present invention have been shown in the drawings and will be described hereafter.

The present invention provides, in addition to microtips participating in the display, at least one area of sacrificial microtips dedicated to the ion pumping.

FIG. 1 shows an embodiment of a flat display screen according to the present invention. Conventionally, a screen according to the present invention is formed of a cathode 1 with microtips 2 and of a grid 3 provided with holes 4 corresponding to the locations of microtips 2. Cathode 1 is placed facing a cathodoluminescent anode 5, a glass substrate 6 of which forms the screen surface. Microtips 2 are generally deposited on cathode conductors 7 organized in columns. Most often, microtips 2 are made on a resistive layer (not shown) deposited on the cathode conductors organized in meshes from a conductive layer, the microtips being arranged within the meshes defined by the cathode conductors. Grid 3 is formed of a conductive layer organized in rows perpendicular to the cathode conductor columns with interposition of an insulator 8 between the cathode and the grid. The rows of grid 3 are provided with a hole 4 above each microtip 2. The intersection of a column 7 of the cathode and of a row of grid 3 defines a screen pixel. For clarity, a single microtip 2 has been shown to be associated with each cathode conductor 7. It should however be noted that the microtips are generally several thousands per screen pixel. The cathode/grid is made on a substrate 9, for example made of glass, forming the bottom of the screen.

Assuming that the representation of FIG. 1 corresponds to a monochrome screen, substrate 6 of anode 5 supports an electrode 10 formed of a plane of a transparent conductive layer such as indium and tin oxide (ITO). Phosphor elements 16 of same color are deposited on this electrode 10. In the case of a color screen (not shown), the anode is generally provided with alternate strips of phosphor elements, each corresponding to a color (red, green, blue). The strips are parallel to the cathode columns and are separated from one another by an insulator. The phosphor elements are then deposited on electrodes formed of corresponding ITO strips.

An empty space 11 is created between the anode and the cathode/grid upon assembly of substrates 6 and 9. Spacers (not shown) generally regularly distributed between grid 3 and anode 5 define the height of space 11 and a peripheral seal (not shown) seals the assembly.

Conventionally, such a screen is controlled by means of an electronic circuit 12 for individually addressing the columns of cathode conductors 7 by links 13, sequentially addressing the rows of grid 3 by links 14, and biasing the anode electrode 10 by means of a link 15. In the case of a color screen, the sets of red, green, and blue strips are alternately biased with respect to the cathode by means of appropriate links.

According to the present invention, cathode 1 includes a sacrificial area of microtips 2' addressable independently from columns 7 by means of an additional electrode 7'. This area is associated with a secondary grid 3' which, according to the embodiment shown in FIG. 1, is addressable independently from the rows of grid 3. As an alternative, the secondary grid may correspond to extensions of rows of main grid 3 participating in the display.

According to the present invention, the sacrificial area of microtips 2' is meant to be addressed, once the screen has been completed, to improve the vacuum in space 11 between electrodes. Thus, according to the present invention, the screen includes active areas of microtips 2 and at least one sacrificial area of microtips 2' addressable independently from one another. The sacrificial microtips are damaged by the ion pumping to which they contribute while the microtips of the active area of the screen are preserved.

Preferably, the anode is provided with a secondary electrode 10' of collection of the electrons emitted by the sacrificial microtip area. For example, an ITO area, preferably without phosphor elements, is provided above the sacrificial microtip area. Electrode 10' is, during the ion pumping, biased to a much higher potential than the potential of grid 3'. This has the advantage that the electrons emitted by the sacrificial microtips 2' are not collected by secondary grid 3' which is thus preserved. Further, the electrons then cross the entire space between electrodes, which increases the probability of hitting a neutral molecule and of turning it into a positive ion. Further, the area where the ionized molecules will be received (secondary grid 3') is thus determined. This is particularly advantageous in the case where the secondary grid is formed of extensions of rows of grid 3 used to extract electrons from the active area.

As an alternative, secondary electrode 10' of the anode is integral with electrode 10, phosphor elements 16 being however deposited, preferably, only above the active microtip areas.

Secondary electrode 10' may be coated with a material having a secondary emission coefficient higher than one to multiply the number of emitted electrons. In this case, a crosswise field may be applied to secondary electrode 10' to further increase the number of electrons by avalanche effect.

In the embodiment shown, electrode 7', secondary grid 3' and secondary grid 10' are addressable by circuit 12 by means of links 13', 14', and 15'. The ion pumping can then be controlled by the electronic screen control circuit. As an alternative, conductors 13', 14', and 15' are also accessible to be individually connected, in the screen manufacturing or during servicing operations, to a specific ion pumping system which will be described hereafter in relation with FIG. 2.

According to the present invention, an ion pumping of the space between electrodes is performed once the screen is completed by biasing secondary grid electrode 3' to an adapted potential, preferably corresponding to the nominal potential of grid 3 in operation (for example, on the order of 80 volts), and by bringing electrode 7' to a potential enabling an electron emission. Preferably, the biasing potential of electrode 7' is included in the range of nominal operating potentials (for example, between 0 and 30 volts) of the active screen area. The choice of the biasing potential of electrode 7' depends on the electron emission intensity desired for the ion pumping. Preferably, to accelerate the ion pumping, the sacrificial area of microtips 2' will be biased to a potential (for example, 0 volts) corresponding to a maximum emission. Preferably, secondary electrode 10' of anode 5 is biased to a potential (for example, on the order of 400 volts) corresponding to a nominal biasing potential of screen electrode 10.

An advantage of the present invention is that, while enabling an ion pumping of space 11 between electrodes, the emissivity of the microtips 2 which participate in the display is not substantially altered.

Another advantage of the present invention is that it enables, if circuit 12 is adapted to controlling the sacrificial area of microtips 2', to performing an ion pumping after the screen has started to be used to trap species which have not been absorbed by the getter and thus prevent the loss of vacuum quality.

According to the present invention, this ion pumping is performed outside screen operating periods, that is, outside the periods when the screen displays images. Preferably, this ion pumping is controlled after each screen turning-off at the end of a use for display. Thus, the vacuum is regenerated for the next use. It has indeed been observed that the vacuum degrades despite the ion pumping that the active microtip areas could perform during operating periods. It is assumed that the species keep on being desorbed immediately after the turning-off. An advantage of providing an ion pumping by means of the sacrificial microtips after each use is that these species are then immediately trapped. Further, the damaging of the microtips of the active areas which are otherwise polluted at the next turning-on of the screen is minimized.

It should be noted that several sacrificial microtip areas can be provided in different areas of the screen to improve the space distribution of the ion pumping. For example, columns parallel to columns 7 may be provided, outside the display area, that is, on either side of the screen. According to another embodiment not shown, sacrificial areas are organized in columns made between two neighboring columns 7 of active microtips 2, that is, used for the display. The sacrificial microtip columns thus obtained are addressable independently from the active columns. In this embodiment, the rows of grid 3 used for the normal addressing of the screen in operation are used to address the sacrificial areas during ion pumping phases. The anode active areas are then, preferably, biased to their nominal operating potential and are used to collect electrons, not only during operating phases, but also during the ion pumping phases.

The choice and the size of the locations of the sacrificial areas depend on the features (shape, resolution, available space between columns) of the microtip active area.

An advantage of the present invention is that the ion pumping requires no generation of an additional potential with respect to those which are available in electronic screen control circuit 12, which limits the adaptations of circuit 12 if it is desired to perform an ion pumping after the screen has started to be used.

Grid 3' may be covered with a specific material (for example, titanium) which will sublimate when hit by an ionized molecule. The gas emitted by this material then deposits back on the grid and the ionized molecules are then buried under the metal. They are then more stable and will be more difficult to extract. This alternative is more specifically meant for cases where the anode is deprived of a secondary electrode facing the microtip sacrificial area.

In the case where the electrons emitted by the sacrificial areas are not collected by the anode, this area of sacrificial microtips 2 can be placed in front of openings (not shown) made in substrate 6 to communicate with a getter receiving enclosure. Advantage is thus taken of presence of an unusable surface for the active area of the screen.

It should be noted that the implementation of a screen according to the present invention requires no modification of the method of manufacturing of the cathode, the anode, and the grid. Only the deposition and etching masks used for the different layers are, according to the present invention, adapted to create the sacrificial area(s), the secondary grid (s), and the additional anode electrode(s).

Figure 2:
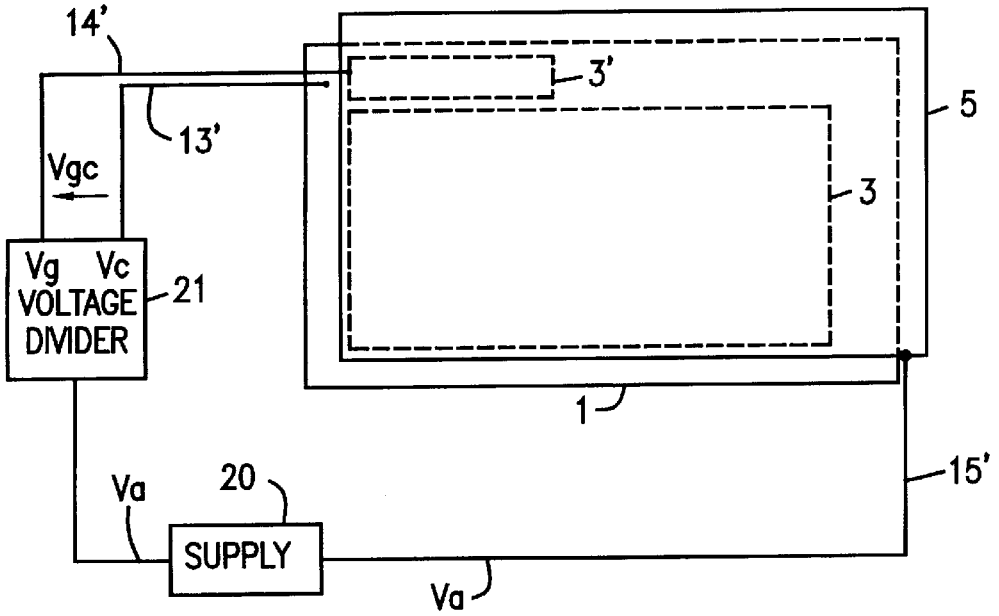
FIG. 2 illustrates an exemplary implementation of the ion pumping method according to the present invention.

FIG. 2 illustrates an embodiment of a method of ion pumping of a screen according to the present invention. This embodiment is more specifically meant for an ion pumping upon manufacturing of the screen or during servicing operations by means of a system independent from screen control circuit 12 (FIG. 1).

In FIG. 2, the screen has been schematically shown in the form of a cathode plate 1 and of an anode plate 5. The active and sacrificial microtip areas are illustrated by the respective positions of main grid 3 and secondary grid 3' shown in dotted lines.

An ion pumping circuit according to the present invention includes a controllable supply circuit 20 (ALIM.) adapted to generating the biasing potentials required for the ion pumping. For example, circuit 20 generates a voltage Va (for example, 400 volts) of biasing of the secondary anode electrode (10', FIG. 1). Voltage Va is sent onto a voltage divider 21 generating secondary grid voltage Vg and voltage Vc of biasing of electrode 7' (FIG. 1) supporting the sacrificial microtips. Voltage Vgc is positive and is, preferably, adjustable to obtain an adjustable emission current. The sacrificial microtip area can be addressed either in pulsed mode or in continuous mode. The advantage of an addressing in continuous mode is that it reduces the ion pumping time. Voltage Va is a constant voltage higher than grid voltage Vg to collect the emitted electrons.

The duration of the ion pumping in the manufacturing depends on the screen volume, on the initial lifetime and on the sacrificial microtip surface. For example, a sacrificial area amounting to between 0.1% and 10% of the active area forms, according to the present invention, a good compromise between the necessary ion pumping duration and the screen bulk.

Of course, the present invention is likely to have various alterations, modifications, and improvements which will readily occur to those skilled in the art. In particular, the biasing potentials during the ion pumping phase will, preferably, be chosen according to the nominal screen operating potentials. Further, the practical implementation of an ion pumping system such as shown in FIG. 2 is within the abilities of those skilled in the art according to the functional indications given hereabove. Similarly, the adaptations of the screen control circuit (12, FIG. 1), in an embodiment where an ion pumping is desired after the screen has started to be used, are within the abilities of those skilled in the art.

Such alterations, modifications, and improvements are intended to be part of this disclosure, and are intended to be within the spirit and the scope of the invention. Accordingly, the foregoing description is by way of example only and is not intended to be limiting. The invention is limited only as defined in the following claims and the equivalent thereto.

What is claimed is:

1. A flat microtip display screen including:

a cathode (1) provided with active areas of electron emission microtips (2);

a cathodoluminescent anode (5) provided, at least in front of the active microtip areas, with active areas of phosphor elements (16);

a main grid (3) for extraction of electrons emitted by the active microtips (2) towards the phosphor elements (16); and on the cathode (1) side, at least one sacrificial area of microtips (2') adapted for being addressed, outside screen operative periods and independently from the acitve area.

2. The screen of claim 1, wherein the sacrificial area of microtips (2') is associated with a secondary grid (3').

3. The screen of claim 2, including, on the anode (5) side, at least one conductive track (10') above the microtip sacrificial area (2'), the conductive track being, during an ion pumping phase, biased to a potential higher than a potential of biasing of the secondary grid (3'), preferably, to a potential corresponding to a nominal potential of addressing of the active areas of phosphor elements (16) of the anode (5).

4. The screen of claim 2, wherein the secondary grid (3') is biased, during an ion pumping phase, to a potential corresponding to a nominal addressing potential of the main grid (3) during screen operation periods.

5. The screen of claim 2, wherein the main (3) and secondary grids are one and the same grid extending above the active and sacrificial microtip areas (2, 2').

6. The screen of claim 1, wherein the sacrificial microtips (2') are addressed, during an ion pumping phase, at a potential included in a range of nominal potentials of addressing of the active areas of microtips (2) during screen operation.

7. The screen of claim 1, wherein the surface of the sacrificial area of microtips (2') is between 0.1% and 10% of the surface of the active areas of microtips (2).

8. The screen of claim 1, in which the active microtip areas (2) are organized in parallel columns and addressable independently from one another, including sacrificial areas of microtips (2') parallel to the columns, each sacrificial area being interposed between two neighboring columns.

9. The screen of claim 1, including two sacrificial microtip areas (2') on either side of the active areas.

10. A method of improvement of a vacuum in a flat microtip screen including a cathode (1) provided with active areas of electron emission microtips (2); a cathodoluminescent anode (5) provided, at least in front of the active microtip areas, with active areas of phosphor elements (16); a main grid (3) for extraction of electrons emitted by the active microtips (2) towards the phosphor elements (16); and on the cathode (1) side, at least one sacrificial area of microtips (2') adapted for being addressed, outside screen operative periods and independently from the active areas, the method comprising the steps of: providing a grid (3') associated with the sacrificial microtips; and applying a positive voltage between the grid (3') associated with the sacrificial microtips and the sacrificial microtip area (2') during an ion pumping phase.

11. The method of claim 10, consisting of performing an ion pumping phase before using the screen.

12. The method of claim 10, wherein an ion pumping phase is performed after each period of screen operation.

* * * * *